United States Patent [19]

Frei et al.

[11] 3,937,184

[45] Feb. 10, 1976

[54] HIGH-PRESSURE STEAM GENERATOR FEED WATER INPUT ARRANGEMENT

[75] Inventors: Gerhard Frei; Heinz-Jürgen Schröder, both of Erlangen, Germany

[73] Assignee: Siemens Aktiengesellschaft, Munich, Germany

[22] Filed: Dec. 4, 1973

[21] Appl. No.: 421,682

[30] Foreign Application Priority Data

Dec. 19, 1972 Germany ..... 2262149

[52] U.S. Cl. ..... 122/32; 122/407

[51] Int. Cl. ..... F22b 1/06; F22d 7/04

[58] Field of Search ..... 122/32, 34, 406 R, 407

[56] References Cited

UNITED STATES PATENTS

| | | | |
|---|---|---|---|
| 2,175,013 | 10/1939 | Blizard | 122/406 |
| 2,861,033 | 11/1958 | Treshow | 122/34 X |
| 3,202,584 | 8/1965 | Bogaardt et al. | 122/407 X |
| 3,653,363 | 4/1972 | Romanos | 122/34 |
| 3,766,892 | 10/1973 | Webster | 122/32 |

*Primary Examiner*—Kenneth W. Sprague
*Attorney, Agent, or Firm*—Kenyon & Kenyon Reilly Carr & Chapin

[57] ABSTRACT

A high-pressure steam generator, particularly for use in a pressurized-water coolant nuclear reactor installation, has a feed water inlet connection provided with a flow choke, such as a flow restricting orifice, through which the normal flow of feed water can pass to the steam generator with little impedance. In the event the pipe line supplying the feed water to the input connection accidentally fails and opens to the atmosphere, the choke becomes effective to very substantially reduce the flow rate of the reversely flowing water through the connection, which then occurs under the high steam pressure of the steam generator. This reduces the forces on the generator's internal construction in the event of such an accident.

4 Claims, 3 Drawing Figures

HIGH-PRESSURE STEAM GENERATOR FEED WATER INPUT ARRANGEMENT

BACKGROUND OF THE INVENTION

A nuclear reactor installation of the pressurized-water coolant type produces useful power via one or more steam generators each having a housing containing a heat exchanger through which the reactor coolant circulates. Such a heat exchanger commonly comprises an inverted U-shaped tube nest having inlet and outlet legs respectively connected to receive and discharge the circulating coolant.

The generator housing has, of course, a suitable steam output outlet and, normally in its lower portion, a feed water input connection supplied with feed water from a source which must provide a higher fluid pressure than the steam pressure in the generator's housing. The outlet leg of the heat exchanger may be provided with a preheater in the form of walls and baffles surrounding the heat exchanger's output leg and into which the feed water input connection opens, the feed water circulating around the output leg of the heat exchanger before entering the main body of water in the steam generator housing.

Such a preheater is normally designed with its various walls and baffles adequately capable of structurally resisting the forces caused by the normal flow of input feed water into the preheater. However, in the event a pipe line connecting the feed water source with the generator's feed water input connection, should fail and open the line pressure to the atmosphere, the steam pressure in the generator's housing produces a reverse flow of water backwardly through the input connection. This reverse flow is at a sufficient velocity to possibly cause damage to the walls and baffles of the preheater. The reverse flow rate created by the high-pressure steam behind the water, may provide forces sufficient to actually disintegrate the preheater, pieces of its construction then flying about within the steam generator's housing and possibly damaging the heat exchanger itself which is a construction that is very expensive. In addition, there is the danger that if the heat exchanger is damaged extensively enough, the reactor coolant may escape within the generator's housing and result in an extremely hazardous condition.

The object of the present invention is to provide a relatively inexpensive but thoroughly effective protective system for avoiding the above indicated possible consequences of a failure on the part of the feed water input supply line.

SUMMARY OF THE INVENTION

According to the invention, the above object is achieved by inserting a flow choke in the steam generator's feed water input connection. This choke may consist of a construction defining an orifice in the input connection and of reduced size relative to the latter. The cross sectional area and possibly the design of the choke orifice should be such as to offer relatively small impedance to the flow of the input feed water under the flow rate and pressure differential under which the latter is normally required to be fed into the steam generator housing. In the reverse direction, however, the size and/or design should be such as to provide for an increased flow resistance in that direction. In any event, any orifice of fixed cross sectional area develops a greatly increased flow resistance with increasing flow pressure differentials. Therefore, in either the case of a specially designed orifice or a simple circular orifice, if the feed water supply line from the high-pressure feed water supply source, should fail and open to the atmosphere, what would otherwise be an extremely high rate and high velocity reverse flow of water under the steam pressure in the generator, is greatly impeded.

The result of choking, impeding or otherwise reducing the velocity and flow rate of the reversely flowing water from the generator, is to reduce the velocity and flow disturbance of the escaping flow through and around the feed water preheater, thus reducing the force hydraulically created, to values approximating, equalling or preferably less than those for which the preheater walls and baffles are designed to withstand under normal operation. In this way destruction of the preheater is prevented, this, of course, eliminating the possibility that pieces of the preheater might be driven about within the steam generator housing with great force such as might result from the forcible ejection of the water under the generator's steam pressure and out via the input connection, in the event the feed water supply pipe line should open.

To further reduce the flow forces applied to the preheater in the event of the type of accident described before, the invention provides for equipping the steam generator's housing with two or more feed water input connections, all opening into the preheater but spaced as far apart from each other as is reasonable and possible. The resulting subdivision of flows, during normal operation, brings the flow forces on the preheater walls and baffles to a very low value, and in the event of an accident when the reverse flow occurs under the high pressure steam force, the flows are broken up or divided with a consequent reduction in the forces which the preheater walls and baffles are required to withstand. The flow in both directions is made more uniform.

BRIEF DESCRIPTION OF THE DRAWING

Referring to the accompanying drawing.

DETAILED DESCRIPTION OF THE INVENTION

Figure 1:
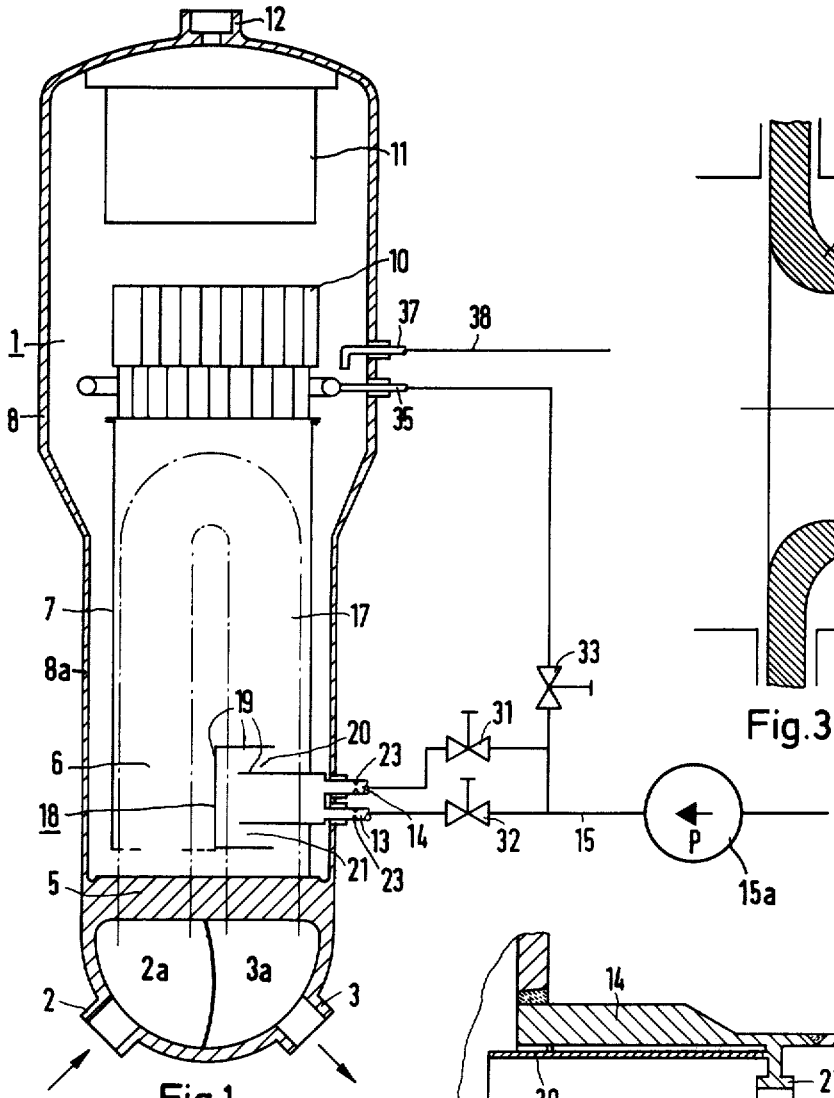
FIG. 1 in vertical section schematically illustrates a typical pressurized-water coolant nuclear reactor installation steam generator, embodying the principles of the present invention.

Referring first to FIG. 1, here the steam generator as a whole is designated by the numeral 1. It is of the type associated with a pressurized-water coolant nuclear reactor. The pressurized-water coolant enters the heat exchanger of the generator via an inlet 2 and is moved out via the outlet 3 by the main reactor coolant pump (not shown). The horizontal tube sheet 5 mounts the inverted U-shaped tube bundle 6 shown only in outline by the broken lines, surrounded by the shell 7 in the lower portion 8*a* of the generator's housing, water ascending upwardly within this shell while evaporating to high pressure steam. The inlet 2 connects with the inlet leg of the heat exchanger via a manifold 2*a*, the outlet manifold 3*a* of the outlet leg of the tube bundle discharging via the outlet 3.

The upper section 8 of the steam generator's housing is enlarged and contains a water separator 10 mounted on top of the shell 7, a moisture separator or fine water separator 11 being mounted above this water separator and connecting with the steam output outlet 12 in the steam dome of the steam generator's housing.

The outside of the shell 7 is spaced from the inside of the housing portion 8a and forms the descent space, the water rising within the shell 7 while evaporating into steam and the water separated by the water separator 10 descending through this descent space between the shell 7 and housing portion 8*a*. The bottom of the shell 7 provides an opening above the tube sheet 5 so that the descending water can flow radially into the space within the shell 7.

A feed water line 15 supplies feed water for the generator at a pressure sufficiently higher than the high pressure steam within the generator's housing, to inject the feed water into the housing. The supply source is indicated as being provided by a pump 15*a*. The heat exchanger, indicated only by the broken lines, has its output leg 17 formed by what is the right-hand leg in FIG. 1, and it is this output leg that is provided with the preheater indicated as a whole by the numeral 18, the preheater walls and baffles being generally indicated at 19. A detailed showing is unnecessary because such preheaters are well known. The drawing of FIG. 1 does indicate that the preheater is formed with two sections, 20 and 21, a feed water input connection 13 feeding the section 21 and another such connection 14 feeding the section 20, to provide the plural connections as previously noted. It is in these connections that the chokes of this invention are inserted, these being indicated at 23. Both input connections are supplied via the pipe line 15, a valve 31 individually controlling the flow rate through the connection 14, and a corresponding valve 32 providing a control of the connection 13. A branch line controlled by a valve 33 leads to a feed water input connection 35, but this is a small capacity line of high reliability and is provided only to maintain the exact water level desired in the upper housing section 8. Correspondingly, there may be other small diameter lines, a connection 37 being shown as provided with a line 38. Such lines of small flow capacity and therefore small diameter, are reliable and do not involve the same possibility of failure as does the main supply line 15 which must feed adequate water into the steam generator to continuously supply the water lost by being evaporated into the high-pressure steam.

As previously indicated, the chokes 23 should, in each instance, be designed to offer little resistance to the flow rate of the input water when everything is operating normally. Using the two connections 13 and 14, an overall increase in the flow resistance may be kept as low as 1.5%. With flow orifices providing for such a reduction, in the event of a break in the supply line 15 orifices of such size can effect a reduction of 50% or less in the water being driven reversely under the high steam pressure in the generator housing. This is sufficient to greatly reduce, if not eliminate, the risk of damage to the walls, baffles or other partitions 19 of the preheater 18.

Figure 2:
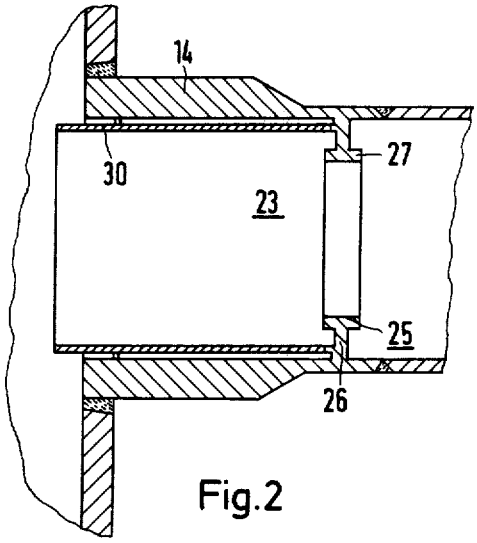
FIG. 2 is a vertical section giving an example of a suitable flow choke inserted in one of the feed water input connections.

FIG. 2 provides an example of a suitable flow choke. Here the orifice 25 is formed by a web 26 mounting a short tubular section 27 symmetrically positioned relative to the axis of the cylindrical connection 14, a cylindrical lining 30 extending inwardly from the web 26 with a larger diameter than that of the inside diameter of the tubular section 27 but in spaced relation to the inside of the connection 14, the latter having the cylindrical interior. This lining 30 is provided to reduce the thermal shock applied to the connection 14 in the event of the reverse flow that occurs should the line 15 open to the atmosphere.

This construction of FIG. 2 is substantially symmetrical in both flow directions with respect to the flow resistance it offers if the flow rates and pressures in opposite directions were substantially equal. However, if the differential pressures increase greatly, as the reverse flow does create in the event of a break in the line 15, the flow resistance increases greatly. In this way the input feed water can flow in with relatively little flow resistance because the pressure differential and its flow rate are only as required to meet the demands of the steam generator. With two connections 13 and 14, it being understood that the connection 13 may be provided with the flow choke of FIG. 2, the input flow rate per connection required to meet the demands of the steam generator is reduced. However, if there is any break in the pipe line connections with either of the connections 13 and 14, the reverse flow rate and pressure differential as the water is forced by the high steam pressure in the direction of the line break, would have a much high flow rate if unrestrained, this flow rate being very extensively reduced by the choke effect of the orifice.

Figure 3:
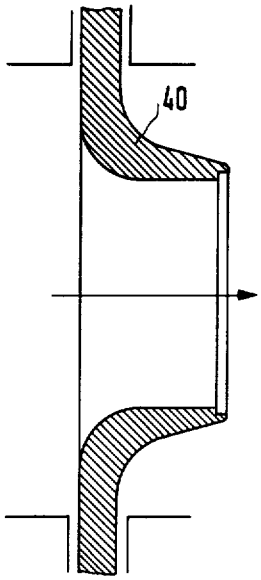
FIG. 3 is a vertical section showing a modification.

In FIG. 3 a choke 40 is indicated, the normal input flow to the generator housing being in the direction of the arrow. This orifice is in the form of a nozzle having a streamline entrance and effecting a flow resistance that is relatively small in the indicated direction. In the reverse direction, opposite to that indicated by the arrow in FIG. 3, such as would occur in the event of a supply line break, the flow resistance is sharply increased over that which would be inherent to the cross sectional area of the orifice provided by the nozzle.

In all cases the restrictive size of the choke used can be determined from available technical information concerning the laws of fluid dynamics, once the principles of the invention have been understood from the foregoing.

What is claimed is:

1. A steam generator having a housing provided with a steam output outlet and at least one feed-water input connection, a heat exchanger in said housing converting water therein to high-pressure steam, a source of feed water under a higher pressure than said steam pressure, and a pipe line connecting said source to said feed water input connection; wherein the improvement comprises a flow restricting choke inserted in said feed water input connection, said choke comprising an orifice dimensioned to offer a small flow resistance to the normal input flow through said connection and a comparatively much larger flow resistance to reverse water flow occurring through said connection under said steam pressure in the event said pipe line accidentally opens to the atmosphere, said generator housing containing a feed water preheater formed by walls and to which said connection feeds, said walls being subject to damage by a water flow at a velocity substantially in excess of the normal feed water input flow.

2. The generator of claim 1 in which said choke is an orifice of substantially smaller diameter than said connection's inside diameter and is formed by a streamlined nozzle pointing in the direction of the normal feed water input flow.

3. The generator of claim 2 in which said housing has a plurality of feed-water input connections with which said pipe line connects, feeding into said preheater, each connection having a substantially corresponding flow choke inserted therein.

4. The generator of claim 3 in which each of said connections has means for controlling the flow rate therethrough.

* * * * *